US010556455B2

(12) United States Patent
Snir

(10) Patent No.: US 10,556,455 B2
(45) Date of Patent: Feb. 11, 2020

(54) HOUSING STRUCTURE FOR MACHINE

(71) Applicant: Kornit Digital Ltd., Rosh HaAyin (IL)

(72) Inventor: Ohad Snir, Kiryat-Ono (IL)

(73) Assignee: Kornit Digital Ltd., Rosh HaAyin (IL)

( * ) Notice: Subject to any disclaimer, the term of this patent is extended or adjusted under 35 U.S.C. 154(b) by 0 days.

(21) Appl. No.: 16/005,743

(22) Filed: Jun. 12, 2018

(65) Prior Publication Data

US 2018/0354282 A1 Dec. 13, 2018

Related U.S. Application Data

(60) Provisional application No. 62/518,028, filed on Jun. 12, 2017.

(51) Int. Cl.

| | |
|---|---|
| ***B41J 29/02*** | (2006.01) |
| ***B41J 29/13*** | (2006.01) |
| ***B41J 1/16*** | (2006.01) |
| ***B41J 2/175*** | (2006.01) |
| *B41J 3/407* | (2006.01) |

(52) U.S. Cl.

CPC ..... *B41J 29/13* (2013.01); *B41J 1/16* (2013.01); *B41J 2/1752* (2013.01); *B41J 29/02* (2013.01); *B41J 3/4078* (2013.01)

(58) Field of Classification Search

CPC ..... B41J 29/13; B41J 29/02; B41J 1/16; B41J 2/1752; B41J 3/4078

See application file for complete search history.

(56) References Cited

U.S. PATENT DOCUMENTS

| | | | | |
|---|---|---|---|---|
| 5,614,115 | A * | 3/1997 | Horton | B23K 26/0846 219/121.67 |
| 5,617,124 | A * | 4/1997 | Taylor | B41J 2/16547 347/35 |
| 5,991,055 | A * | 11/1999 | Haselby | H04N 1/1911 358/505 |
| D567,264 | S | 4/2008 | Muller et al. | |
| D592,683 | S | 5/2009 | Warth | |
| D677,723 | S * | 3/2013 | Buel | D18/59 |
| D757,828 | S | 5/2016 | Lange et al. | |
| D759,134 | S | 6/2016 | Goldhagen et al. | |
| D765,745 | S | 9/2016 | Cheung | |
| D777,809 | S | 1/2017 | Wu | |
| 2007/0013736 | A1* | 1/2007 | Higginson | B41J 2/175 347/37 |
| 2014/0292859 | A1* | 10/2014 | Aruga | B41J 2/04501 347/12 |

OTHER PUBLICATIONS

Official Action dated Apr. 12, 2018 From the US Patent and Trademark Office Re. U.S. Appl. No. 29/607,195. (13 pages).

* cited by examiner

*Primary Examiner* — Yaovi M Ameh

(57) ABSTRACT

A housing for an industrial machine, consists of first and second oppositely facing plates. Two cross beams are connected between the first and second plates to make the first and second plates into endplates of an enclosure for the industrial machine which may be placed inside. Front and rear pivoted closures are located between the endplates above the enclosure, which are opened to provide access to the enclosure for repair, maintenance etc., of the industrial machine housed therein.

19 Claims, 9 Drawing Sheets

HOUSING STRUCTURE FOR MACHINE

RELATED APPLICATION

This application claims the benefit of priority under 35 USC § 119(e) of U.S. Provisional Patent Application No. 62/518,028 filed on Jun. 12, 2017, the contents of which are incorporated herein by reference in their entirety.

FIELD AND BACKGROUND OF THE INVENTION

The present invention, in some embodiments thereof, relates to a housing structure for a machine and, more particularly, but not exclusively, to a housing structure that maximizes use and maintenance access to an industrial or semi-industrial machine including a textile printer.

Industrial machines are located in harsh environments and need to be protected from external knocks and spills, and chemicals in the air and the like. In addition, the machinery being housed needs to be safely contained, so as not to cause injury or produce spillages, allow harmful chemicals to evaporate, produce too much noise etc.

However placing a machine in a solid box is not a solution. The machine needs to be used, managed and maintained, with specific access to numerous parts of the machine. Thus a housing generally has to be custom designed so that it houses, and as necessary mounts, the machine effectively and also provides access to the required maintenance locations, and further allows access for repairs. Often parts of the machine are separately housed, or even if the housing is integrated overall, the parts of the housing are designed separately for different purposes. The housing design may be required to distribute the weight of the machine on the factory floor and may be required to allow the machine to be levelled. Walls of the housing are usually not precisely aligned and thus cannot be used as a basis for aligning parts of the machine.

SUMMARY OF THE INVENTION

The present embodiments provide a housing that consists of two oppositely facing mounting plates held together with structurally integral crossbeams. The machine is mounted between the mounting plates and access is provided over the entire front and back of the machine by closable wings, or closures, that close between the mounting plates. A three-crossbeam structurally integral system may be incorporated into the housing to allow for reliable alignment of the plates, which may then be used to align the parts of the machine.

According to an aspect of some embodiments of the present invention there is provided a housing for an industrial machine, comprising:

first and second plates;

two cross beams each connected between said first and second plates to form said first and second plates into endplates of an enclosure for said industrial machine; and front and rear pivoted closures located between said endplates above said enclosure, said pivoted closures being openable to provide access to said enclosure.

The housing may comprise a third cross beam connected between said first and second plates.

In an embodiment, said first and second cross beams are at a horizontal alignment with respect to each other, and said third cross beam is raised above said horizontal alignment of said first and second cross beams.

In an embodiment, said third cross beam is located substantially half way between said first and second beams.

The housing may comprise fourth and fifth cross beams connecting between lower outer edges of said first and second plates to define respective lower ends of said enclosure.

The housing may comprise a floor between said fourth and fifth cross beams.

The housing may comprise at least four levelers extending below said fourth and fifth cross beams.

In an embodiment, said floor is a sheet metal floor.

In an embodiment, the plates each comprise a three-terminal reinforcement structure connected between ends of said first, second and third cross-beams.

In an embodiment, said pivoted closures are pivoted above said third cross-beam.

In an embodiment, said pivoted closures comprise rolled sheets of metal.

The housing is made to be combined with an industrial machine placed in said enclosure and may be so provided.

The industrial machine may be for example a textile printing machine.

In an embodiment, said textile machine comprises a printing head and a printing tray, said printing head being attached to said third cross beam and said printing tray running across a structure supported at least partially by said first and second cross beams.

In an embodiment, said textile machine further comprises a cable chain and cables, said cables and said printing head being accessible for maintenance through said pivoted closures.

The housing may comprise an opening on one of said plates, and a slidable tray within said opening for holding a removable tank for servicing said machine.

In an embodiment, said machine comprises a spray bar carrying spray units.

According to a second aspect of the present embodiments there is provided a method of manufacturing a housed industrial machine, comprising:

making an enclosure by connecting two flat plates via first and second cross-beams, the two cross-beams being along a horizontal alignment;

adding a third cross-beam between two said plates, the third cross-beam being raised with respect to said horizontal alignment;

placing first and second pivoted closures between said plates to close said enclosure from above;

placing said industrial machine to be supported by said first and second cross beams; and placing an operating head of said industrial machine in association with said third cross-beam.

The method may comprise adding reinforcement structures to said plates to provide right angles for aligning said first, second and third cross-beams.

The method may comprise using the housing structure to align parts of said industrial machine with each other.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
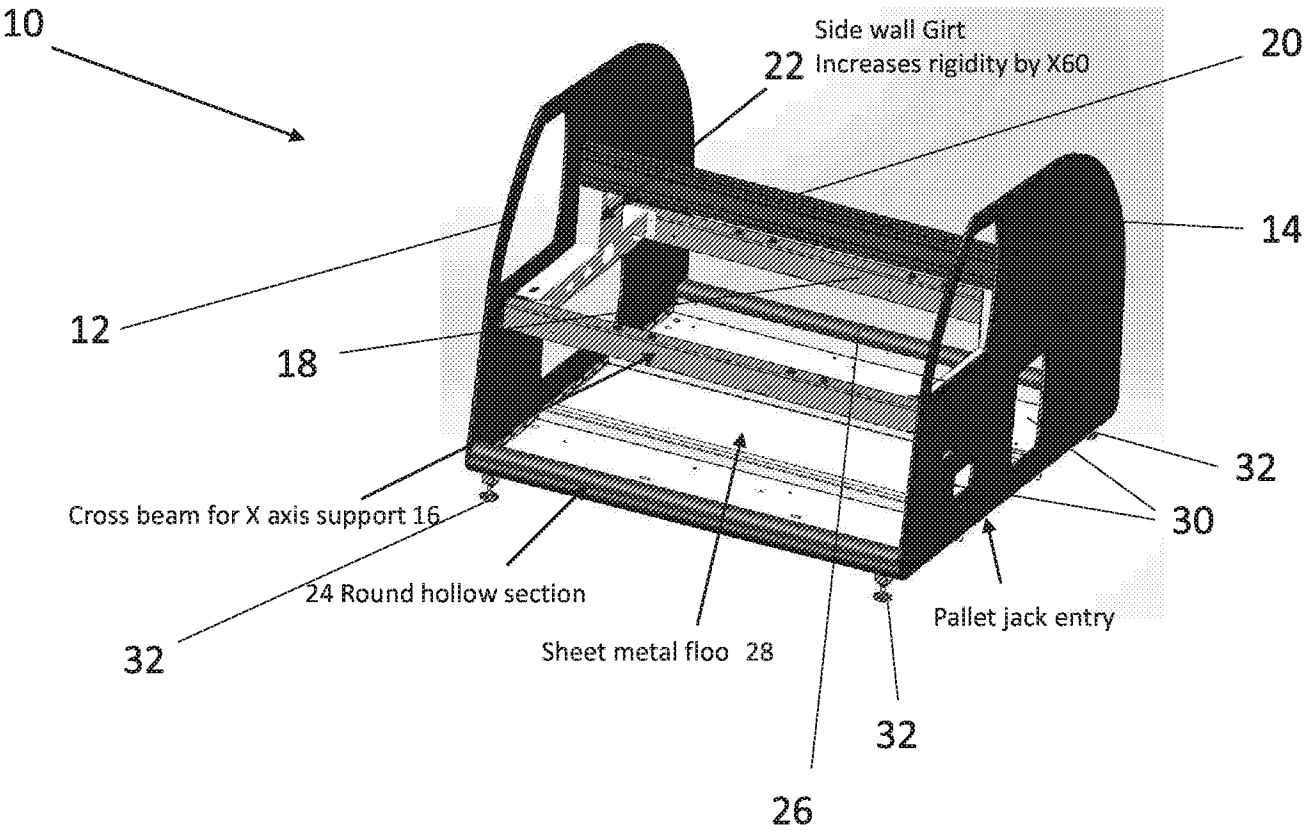
FIG. 1 is a simplified diagram of a housing according to the present embodiments, including side plates, reinforcement structures and cross-beams.

The present invention, in some embodiments thereof, relates to a housing structure for a machine and, more particularly, but not exclusively, to a housing structure that maximizes use and maintenance access to an industrial or semi-industrial machine including a textile printer.

The housing consists of first and second oppositely facing plates. Two cross beams are connected between the first and second plates to make the first and second plates into endplates of an enclosure for the industrial machine which may be placed inside. Front and rear pivoted closures are located between the endplates above the enclosure, which are opened to provide access to the enclosure for repair, maintenance etc., of the industrial machine housed therein.

The first and second cross-beams may be connected horizontally between the two plates, and the two cross-beams may be aligned with each other horizontally. The machine is placed in the enclosure with the cross-beams available to support parts of the machine. The closures are pivoted to the plates to close over the machine for use and can be opened to give full access to the machine from above and from the front and back for maintenance. A third cross-beam may be connected between the plates at a location which is raised horizontally with respect to the first two cross beams, and typically at a distance intermediate between them, so that the three beams form an isosceles triangle. One or more of the cross-beams may be I-beams. The triangle structure may hold the plates in firm alignment, and reinforcement structures on the plates may be provided to define the positions of the cross-beams and ensure that the alignment is as exact as possible with firm right angles between the beams and the plates.

The third cross-beam may serve as a support for an operating head of the machine, and even as a rail if the operating head is required to move from side to side.

Openings may be made wherever required in the plates, for utility drawers, for maintenance access and for any other need.

The machine may be a textile printing device, having a conveyor or moving arm or the like connected over the first and second cross beams to carry print trays. A print head may be carried by the third cross beam and may provide printing ink as well as pre-treatment and post treatment fluids. The pre-treatment fluids may include wetting fluids as well as fluids for counteracting the pH of the inks. The post-treatment fluids may include softeners, coatings, and fixation fluids, and curing features may also be provided.

Color is affected by the underlying fabric and thus the inks may include white ink to provide an undercoat before color printing on dark fabrics.

The printing head may be powered and controlled by cables in a cable chain, and the pivoted closures may provide easy maintenance access to the printing head and cables.

A spray bar may be provided in advance of the printing head. The spray bar may be connected horizontally between the two plates, and may provide some or all of the pre-processing fluids instead of the printing head.

The pre-processing fluid, as with other fluids required by the machine, may be placed in removable tanks. Utility openings as mentioned above may be provided with a slidable tray to carry the tank. The tank is placed on the slidable tray and can be pulled out and replaced with a new tank without stopping operation of the machine.

In an embodiment, two or more printing trays may fit side by side on the conveyor.

In use the pivoted closures are shut to provide protection to the machine and to the environment around the machine.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 illustrates a housing according to an embodiment of the present invention. The housing 10 comprises first and second flat plates 12 and 14, connected together by first and second cross beams 16 and 18. A third cross-beam 20 forms a triangle with the first and second cross beams, the first and second beams being horizontally aligned. That is to say the third beam 20 is raised with respect to the horizontal alignment of the first and second beams. The third beam may be half way between the first and second beams and may form an isosceles triangle with the first and second beams. The beams provide structural rigidity. The third beam may be an I-beam, as may either of the first and second beams. Reinforcement structures 22 in the shape of inverted T's, three-terminal reinforcement structures, may be placed on the plates to more precisely locate the cross-beams on the plates and increase rigidity. Each terminal of the T may physically abut the end of one of the first, second and third cross-beams respectively to form a firmly held right angle with each beam. The reinforcement structures may thus increase rigidity by up to 60 times.

Fourth and fifth cross-beams 24 and 26 may connect the lower ends of the plates and may thus define lower outer extremities of the enclosure. A sheet metal floor 28 may extend underneath the enclosure between the fourth and fifth beams. The sheet metal floor is not necessarily load bearing but may be required to stop spray or vibrations and the like. The fourth and fifth cross-beams 24 and 26 may optionally be hollow tubes.

Various holes 30 may be cut into the metal plates for maintenance access to parts of the machine not accessible from above, such as a pallet jack entry.

Levelers 32 may provide adjustable legs at the four corners of the housing. Additional levelers may be provided as needed to spread load. The levelers typically are attached to the fourth and fifth cross-beams but may alternatively support the plates directly.

Figure 2:
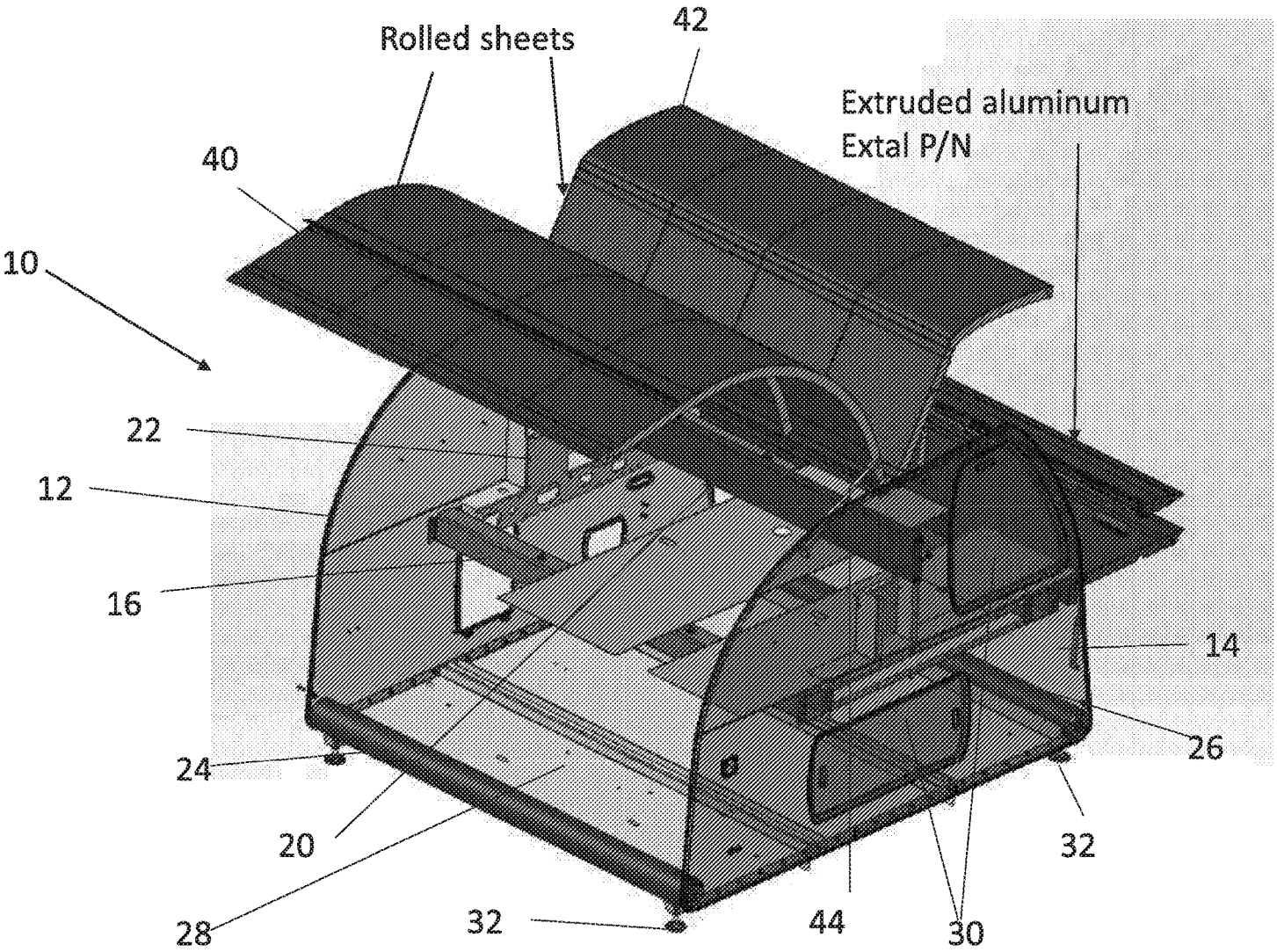
FIG. 2 is a simplified diagram of the housing of FIG. 1 with pivoted closures connected to cover the housing from above.

Reference is now made to FIG. 2, which is a schematic diagram of the housing of FIG. 1. Parts that are the same as in FIG. 1 are given the same reference numerals and are not described again except as needed for an understanding of the present embodiments. Pivoted closures 40 and 42 are connected between the plates from above to cover the enclosure during use and may allow full access from above and from the front and back to the machine in the enclosure for maintenance, repair and other needs. The closures may be pivoted above the third cross beam, and may for example be operated by a hydraulic mechanism 44. The closures may open as wings and may be linked via hydraulic mechanism 44 so that manually opening one closure causes the second closure to open automatically. In an embodiment, the hydraulic mechanism may have a fail-safe feature discussed below that ensures that the closures are left in the open position should the hydraulics fail, thus ensuring the safety of maintenance operators. The closures may helpfully be constructed of rolled metal sheet.

Figure 4:
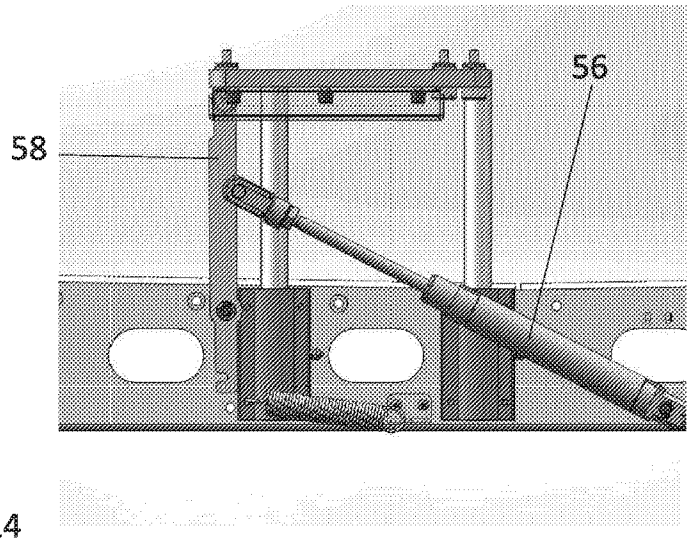
FIG. 4 is a detail of the hydraulic lift mechanism of FIG. 3 with a cam follower to make the mechanism fail safe.
Figure 3:
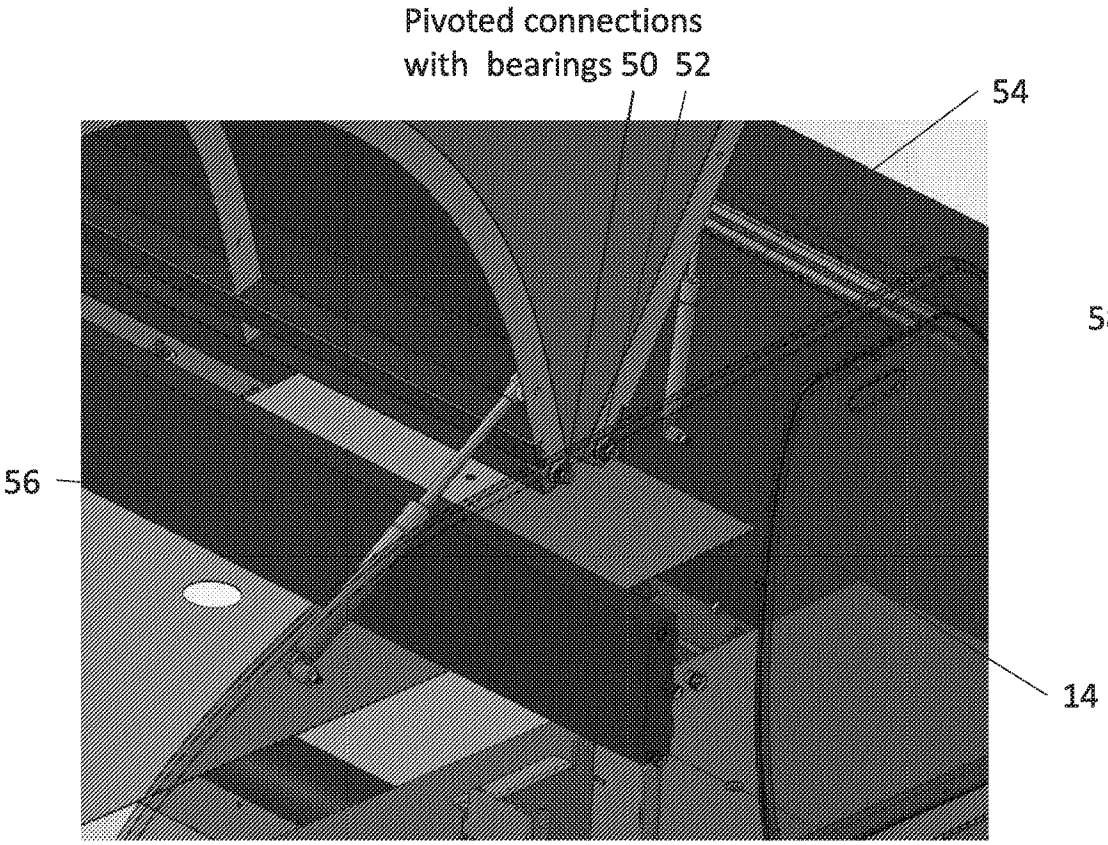
FIG. 3 is a detail of the connection of the closures of FIG. 2 with a hydraulic lift mechanism.

Reference is now made to FIG. 3 which shows in greater detail the connections of the closures to one of the plates. Closure 40 is connected via a pivot 50 and a bearing to plate 14. Closure 42 is connected likewise, via pivot 52 and another bearing, and the two closures may face each other back to back across the top of the enclosure. Hydraulic arms 54 and 56 are part of a hydraulic lift mechanism that opens the closures. FIG. 4 illustrates the hydraulic lift mechanism from the inside of the enclosure and shows cam follower 58 which arrests the hydraulic lift mechanism in the open state in the event of sudden loss of hydraulic pressure, thus providing the fail-safe feature discussed above.

Figure 5:
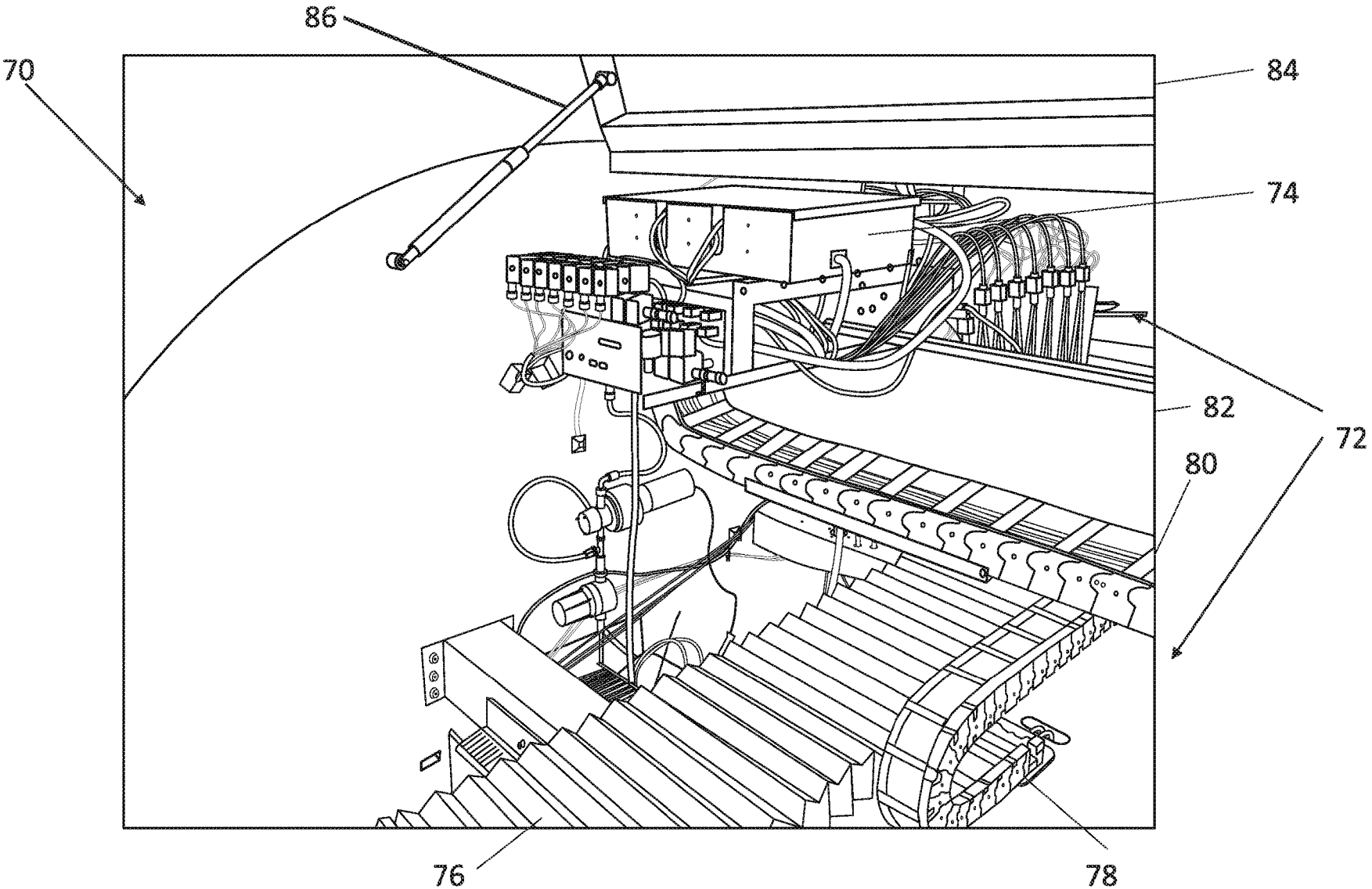
FIG. 5 is a photograph showing an exemplary printing machine inserted into a housing according to the present embodiments, with a print head over the third beam and the print trays and movement arms supported over the first two beams.

Reference is now made to FIG. 5, which is a photograph of a non-limiting example of a housing 70 according to the present embodiments with an industrial machine 72 placed in the closure to be housed therein. The industrial machine may be any kind of an industrial machine that requires housing with ready access for maintenance, repair etc. As shown in the example in the photograph, the machine is an inkjet printing machine for printing textiles.

FIG. 5 illustrates how the three-cross-beam structure of the housing 70 may be used to accommodate the machine 72. The textile printing machine has a printing head 74 and a moving arm 76 that controllably moves a printing tray (shown in FIG. 6) under the printing head 74. The moving arm 76 is controlled and powered via cable chain 78, and the printing head 74 is controlled and powered via cable chain 80. The printing head 74 may be mounted on the third cross beam 82, which may include a rail to allow the printing head to travel across the enclosure. The moving arm and printing tray may run across the path of the printing head from underneath and may be part of a structure that rests on or is at least partially supported by the first and second cross beams. Furthermore the cross beams and the plates may be sufficiently structurally aligned with accurate right angles to allow the beams and/or the plates to be used as the basis for aligning the parts of the machine.

As shown in FIG. 5, closure 84 is held open by hydraulic lift 86, and the cable chains and cables, as well as the printing head with ink cartridges and ink nozzles, and the moving arm, are all readily accessible through the opening.

Figure 6:
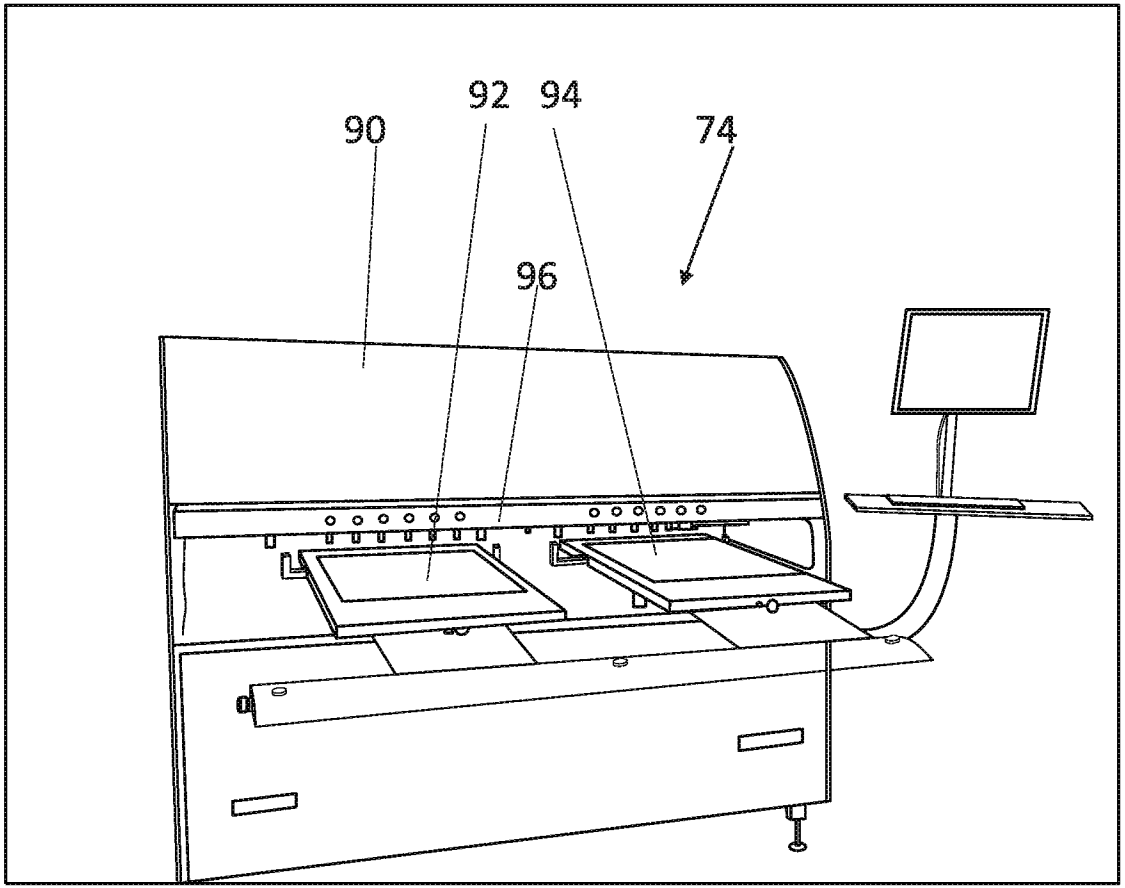
FIG. 6 is a view from the front of the housing of FIG. 5 with the printing machine, and showing twin print trays.

Reference is now made to FIG. 6, which is a photograph from the front of the example of FIG. 5, in which a housing according to the present embodiments houses a textile printing machine. Housing 74 is shown with closure 90 in the closed position. Twin print trays 92 and 94 provide improved throughput in that one tray may be loaded while the other tray is being printed, thus saving on down time. Spray bar 96 is fitted between the plates 98 and 100 of the housing, and includes spray units or nozzles or holes, which spray pre-processing fluid onto the print job prior to reaching the print head.

Figure 7:
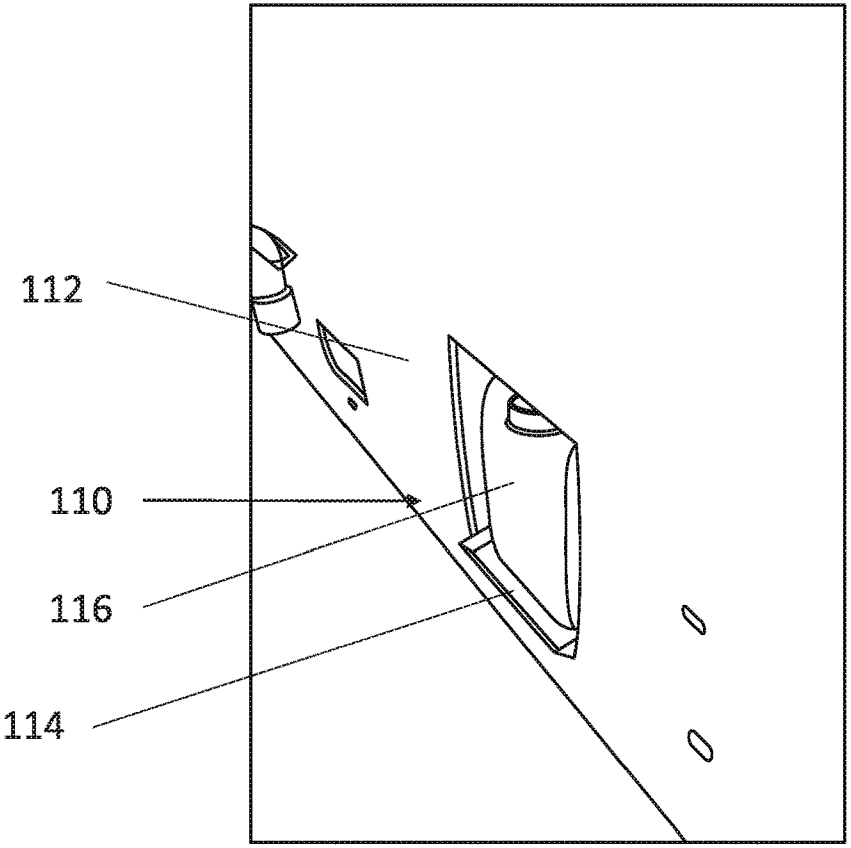
FIG. 7 is a photograph showing a side utility drawer in the housing, containing a supply tank on a sliding tray.

As discussed, since the side of the housing is simply a flat plate, it is possible during the manufacturing process or afterwards to cut openings in the plate to make additional access slots, both for maintenance repair access and for utility purposes. Reference is now made to FIG. 7, which illustrates a utility opening 110 in plate 112 at one side of a housing. The utility opening includes a slide tray 114, which in this case holds a tank 116. The tank may include any liquid needed by the machine and in the case of the textile printer holds pre-processing fluid for spraying via the spray bar 96.

Figure 8:
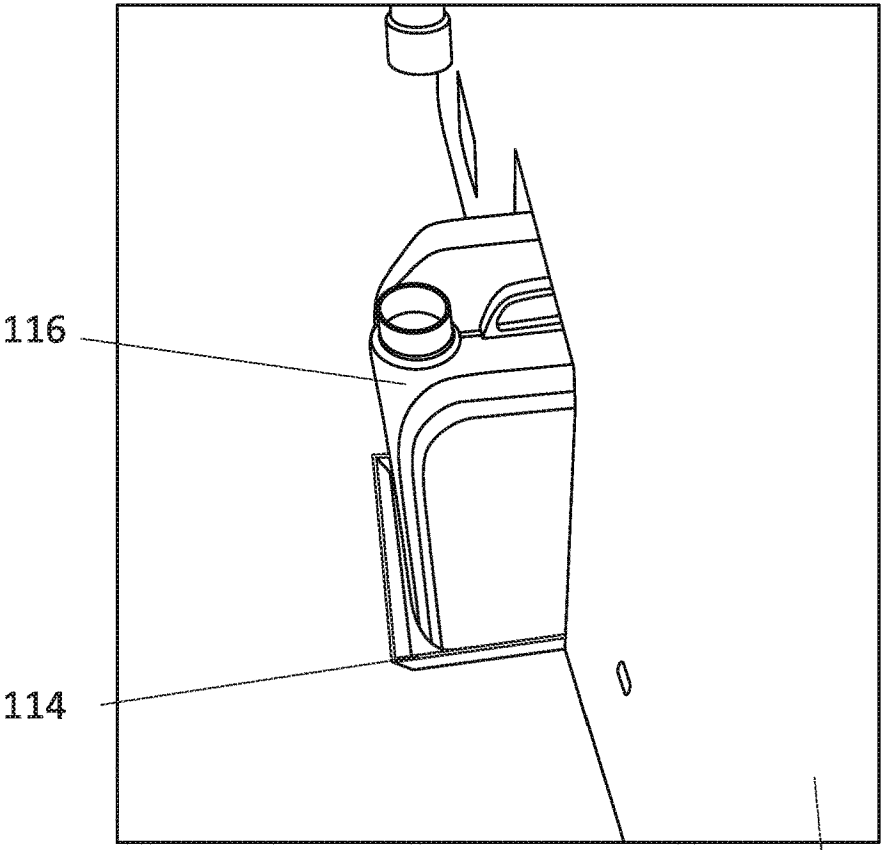
FIG. 8 is a view of the tank of FIG. 7 on the sliding tray, which tray is partly extended from the housing.
Figure 10:
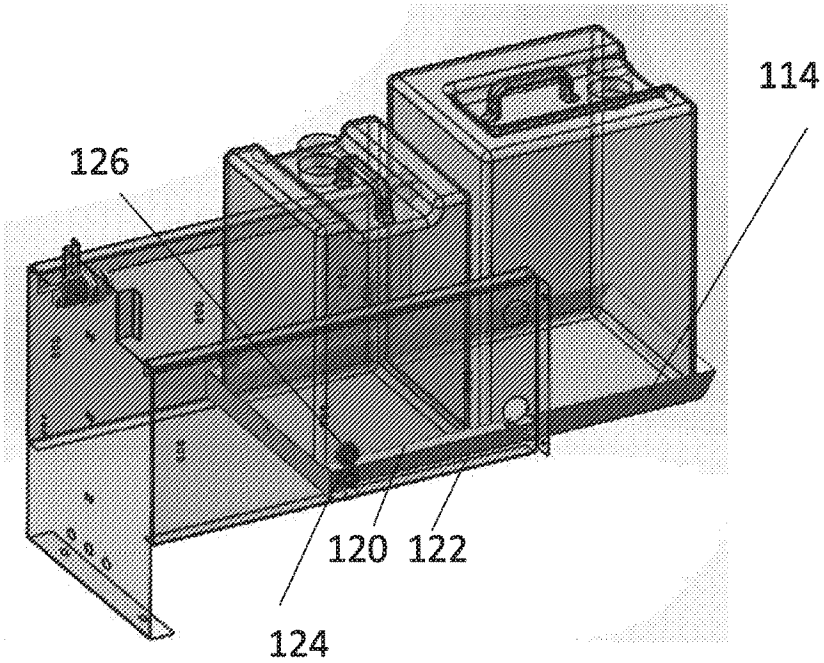
FIG. 10 is a simplified diagram showing the tray and sliding mechanism of FIG. 8 with the tray in the extended position.
Figure 9:
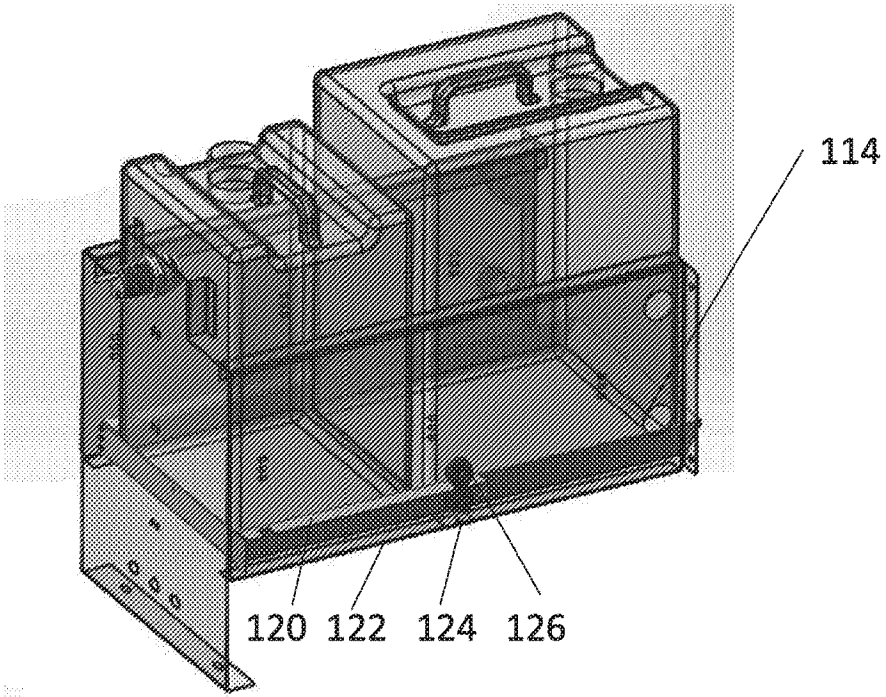
FIG. 9 is a simplified diagram showing an exemplary sliding mechanism for the tray of FIG. 8 with the tray in a retracted position.

The tank may be replaced simply by pulling out the slide tray and replacing the tank and may be done quickly enough as not to require stopping the machine. FIG. 8 shows the tank 116 on the tray 114 after the tray has been pulled partially outside of the housing past plate 112. FIGS. 9 and 10 illustrate an exemplary sliding drawer construction for the tray 114. The sliding drawer construction involves providing the tray 114 with upper guide rail 120 and placing the tray on lower guide rail 122. Lower roller 124 runs between the upper and lower guide rails and upper roller 126 runs above the upper guide rail so that the tray runs easily between the internal position shown in FIG. 9 and the external position shown in FIG. 10.

Figure 11:
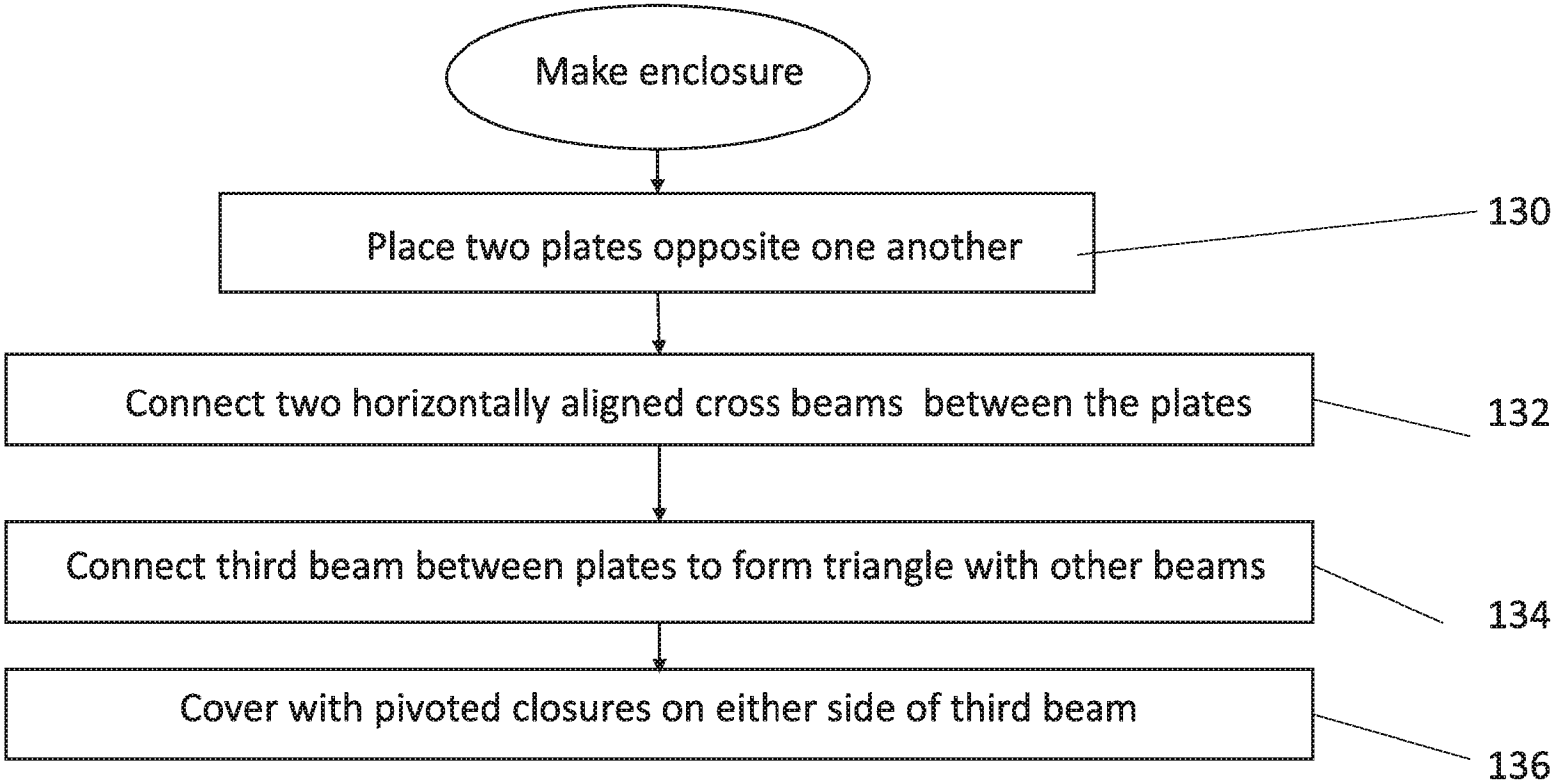
FIG. 11 is a simplified flow chart illustrating a process of manufacturing a housing according to the present embodiments.

Reference is now made to FIG. 11, which is a simplified flow chart showing a method of manufacturing a housing for an industrial machine. The method comprises obtaining two metal plates of suitable size and shape and placing them opposite each other 130. Then 132 two beams are connected between the plates in such a way that the beams are horizontally aligned. A third beam is then connected 134 between the two plates at a location that is offset upwardly from the first two beams. The three beams thus form a triangle, which may in embodiments be an isosceles triangle as the third beam may be placed midway between the first two beams. A T-shaped reinforcement element may be attached on the inside of the plates to abut each of the beams to force them into a clearly defined right angle at each junction, as discussed hereinabove to give structural integrity. Then the enclosure formed between the two plates is covered 136 by two pivoted closures which can be opened to provide maintenance and repair access to the enclosure.

Figure 12:
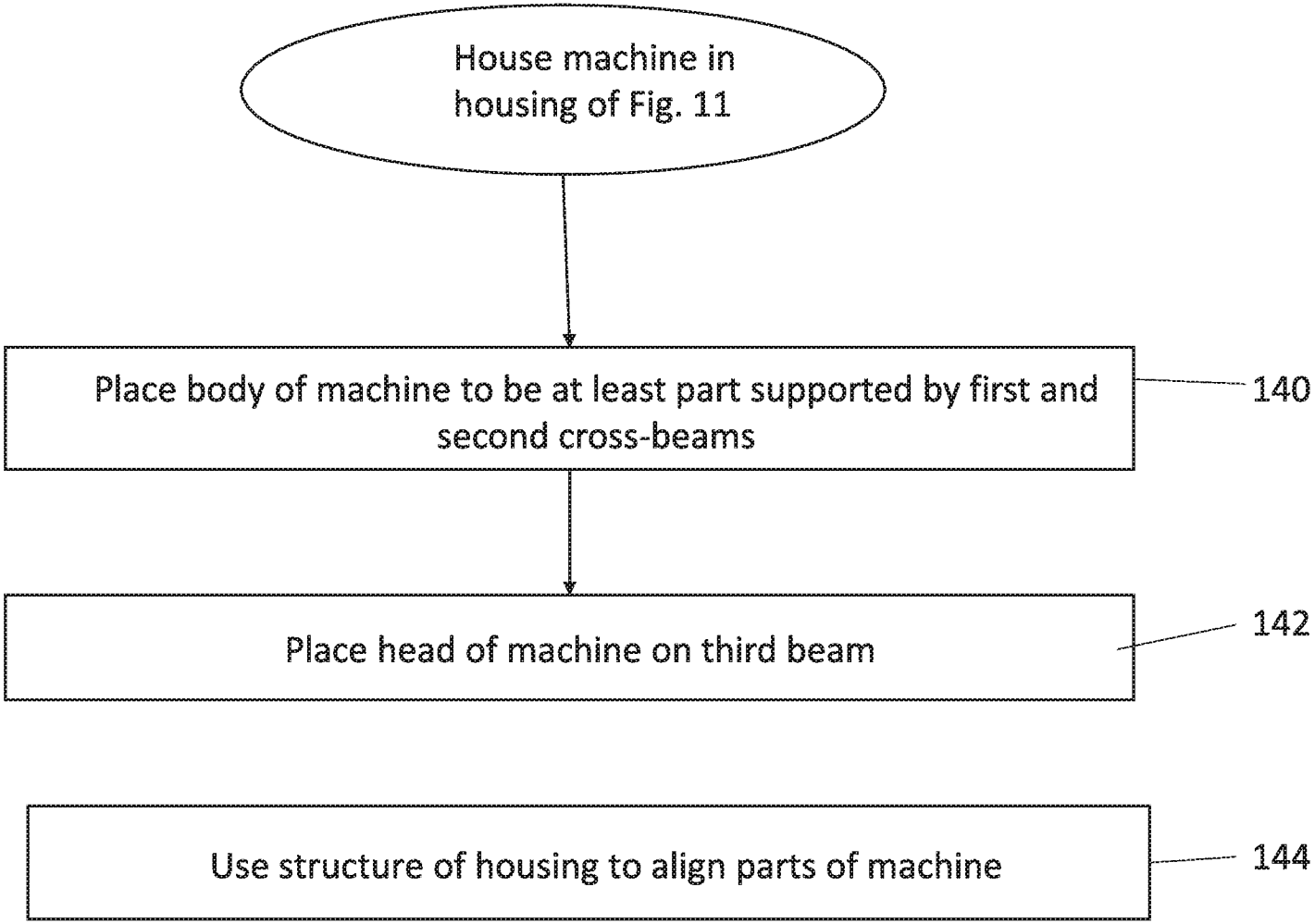
FIG. 12 is a simplified flow chart illustrating a process of building an industrial machine into the housing of FIG. 11.

Reference is now made to FIG. 12, which is a simplified flow chart illustrating the procedure of housing a machine in the housing of FIG. 11. It is noted that in practice at least some of the stages in FIG. 11 may be carried out after stages in FIG. 12 as convenient.

The machine is placed within the housing. A machine that has a head and a body may be integrated within the housing by placing 140 the body of the machine to be supported at least partly by the first and second cross beams. The operating head may be placed on 142 or at least partly supported by the third cross-beam. In the case of a printing head or like heads of other machines that are required to traverse the width of the machine as part of their operation, the third cross-beam may include a rail for the head to travel on.

The triangular shape with reinforcement elements makes the housing structurally very well defined and thus the plates and the cross-beams can be used as the basis for aligning the machine parts with each other. Thus the head may be aligned 144 with the body of the machine, and in the case of the printer this would mean that the head of the printer is aligned with the print trays below in order to provide uniform printing.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A housing for an industrial machine, comprising:

first and second plates;

first and second cross beams each connected between said first and second plates to form said first and second plates into endplates of an enclosure for said industrial machine; and front and rear pivoted closures located between said endplates above said enclosure, said pivoted closures being openable to provide access to said enclosure, wherein the industrial machine is a textile printing machine, and said textile printing machine comprises a printing head and a printing tray, said printing head being attached to a third cross beam and said printing tray running across a structure supported at least partially by said first and second cross beams.

2. The housing of claim 1, wherein said third cross beam is connected between said first and second plates.

3. The housing of claim 2, wherein said first and second cross beams are at a horizontal alignment with respect to each other, and said third cross beam is raised above said horizontal alignment of said first and second cross beams.

4. The housing of claim 3, wherein said third cross beam is located substantially half way between said first and second beams.

5. The housing of claim 1, further comprising fourth and fifth cross beams connecting between lower outer edges of said first and second plates to define respective lower ends of said enclosure.

6. The housing of claim 5, comprising a floor between said fourth and fifth cross beams.

7. The housing of claim 5, comprising at least four levelers extending below said fourth and fifth cross beams.

8. The housing of claim 6, wherein said floor is a sheet metal floor.

9. The housing of claim 3, wherein the plates each comprise a three-terminal reinforcement structure connected between ends of said first, second and third cross-beams.

10. The housing of claim 3, wherein said pivoted closures are pivoted above said third cross-beam.

11. The housing of claim 1, wherein said pivoted closures comprise rolled sheets of metal.

12. The housing of claim 1, with an industrial machine placed in said enclosure.

13. The housing of claim 1, wherein the industrial machine is a textile printing machine.

14. The housing of claim 1, wherein said textile machine further comprises a cable chain and cables, said cables and said printing head being accessible for maintenance through said pivoted closures.

15. The housing of claim 12, further comprising an opening on one of said plates, and a slidable tray within said opening for holding a removable tank for servicing said machine.

16. The housing of claim 12, wherein said machine comprises a spray bar carrying spray units.

17. A method of manufacturing a housed industrial machine, comprising:

making an enclosure by connecting two flat plates via first and second cross-beams, the two cross-beams being along a horizontal alignment;

adding a third cross-beam between two said plates, the third cross-beam being raised with respect to said horizontal alignment;

placing first and second pivoted closures between said plates to close said enclosure from above;

placing said industrial machine to be supported by said first and second cross beams; and placing an operating head of said industrial machine in association with said third cross-beam.

18. The method of claim 17, further comprising adding reinforcement structures to said plates to provide right angles for aligning said first, second and third cross-beams, or using the housing structure to align parts of said industrial machine with each other.

19. The method of claim 17, wherein said industrial machine is a textile printing machine and said operating head is a printing head.

* * * * *